US011617245B2

(12) United States Patent
Zhang et al.

(10) Patent No.: US 11,617,245 B2
(45) Date of Patent: Mar. 28, 2023

(54) LED DRIVER WITH SELECTABLE LUMEN AND CCT

(71) Applicant: ABL IP HOLDING LLC, Atlanta, GA (US)

(72) Inventors: Hang Zhang, North Reading, MA (US); Peng Xiao, Andover, MA (US); Tiberiu Antohi, Woburn, MA (US)

(73) Assignee: ABL IP HOLDING LLC, Atlanta, GA (US)

( * ) Notice: Subject to any disclaimer, the term of this patent is extended or adjusted under 35 U.S.C. 154(b) by 223 days.

(21) Appl. No.: 16/989,949

(22) Filed: Aug. 11, 2020

(65) Prior Publication Data

US 2022/0053617 A1 Feb. 17, 2022

(51) Int. Cl.
*H05B 45/20* (2020.01)
*H05B 45/385* (2020.01)
*H05B 45/345* (2020.01)

(52) U.S. Cl.
CPC ..... *H05B 45/20* (2020.01); *H05B 45/345* (2020.01); *H05B 45/385* (2020.01)

(58) Field of Classification Search
CPC .... H05B 45/20; H05B 45/345; H05B 45/385; H05B 45/10; H05B 45/30; H05B 45/37; H05B 45/3725; H05B 45/48; H05B 47/10; H05B 47/11; H05B 47/105
See application file for complete search history.

(56) References Cited

U.S. PATENT DOCUMENTS 6,967,447 B2 * 11/2005 Lim ..... H05B 45/00 315/291
8,525,446 B2 * 9/2013 Tikkanen ..... H05B 45/10 315/312
8,598,809 B2 * 12/2013 Negley ..... H05B 45/22 315/297
8,981,677 B2 * 3/2015 Myers ..... H05B 45/22 315/309
9,237,612 B1 * 1/2016 Lewis ..... H05B 45/46
9,538,604 B2 1/2017 Yadav et al.
9,603,218 B1 * 3/2017 Bohler ..... H05B 45/60
9,723,683 B2 8/2017 Yadav et al.
9,788,373 B1 * 10/2017 Chowdhury ..... H05B 45/395
(Continued)

FOREIGN PATENT DOCUMENTS

JP 3201268 U * 12/2015

*Primary Examiner* — Haissa Philogene
(74) *Attorney, Agent, or Firm* — Kilpatrick Townsend & Stockton LLP

(57) ABSTRACT

The systems and methods disclosed herein include a LED driver, including a current output module configured to generate a constant current output split between a plurality of output channels, each output channel connected to one or more LEDs having an associated CCT value, at least one switch encoding a plurality of lumen settings and a plurality of CCT settings, and at least one circuit coupled to the current output module and the switch, the at least one circuit configured to determine a first lumen setting from the plurality of lumen settings encoded by the at least one switch, adjust the constant current output of the current output module based on the first lumen setting, determine a first CCT setting from the plurality of CCT settings encoded by the at least one switch, and adjust the plurality of output channels of the current output module based on the first CCT setting.

16 Claims, 3 Drawing Sheets

(56) References Cited

U.S. PATENT DOCUMENTS

| | | | | |
|---|---|---|---|---|
| 9,820,350 | B2 | 11/2017 | Pyshos et al. | |
| 9,844,112 | B2 | 12/2017 | Yadav et al. | |
| 9,892,693 | B1 | 2/2018 | Kumar et al. | |
| 10,051,706 | B2 | 8/2018 | Yadav et al. | |
| 10,117,300 | B2 | 10/2018 | Doheny et al. | |
| 10,163,405 | B2 | 12/2018 | Kumar et al. | |
| 10,219,345 | B2 * | 2/2019 | Yan | H01L 25/0753 |
| 10,285,237 | B2 * | 5/2019 | Lal | H05B 47/19 |
| 10,292,233 | B1 | 5/2019 | Udavant et al. | |
| 10,299,335 | B2 | 5/2019 | Pyshos et al. | |
| 10,683,969 | B2 * | 6/2020 | Jeswani | F21K 9/275 |
| 10,880,968 | B1 * | 12/2020 | Zhou | H05B 45/20 |
| 2007/0273290 | A1 * | 11/2007 | Ashdown | F21V 29/717 315/113 |
| 2008/0164826 | A1 * | 7/2008 | Lys | H05B 45/44 315/250 |
| 2009/0195189 | A1 * | 8/2009 | Zampini | H05B 45/00 315/313 |
| 2011/0180687 | A1 * | 7/2011 | Rains, Jr. | G01J 3/10 250/205 |
| 2015/0208469 | A1 * | 7/2015 | Coetzee | H02M 1/36 315/307 |
| 2015/0305103 | A1 * | 10/2015 | Shah | H05B 45/60 315/294 |
| 2016/0007419 | A1 * | 1/2016 | Lee | G02B 6/0068 315/185 R |
| 2018/0368232 | A1 | 12/2018 | Doheny et al. | |
| 2018/0376555 | A1 * | 12/2018 | Wang | H05B 45/20 |
| 2019/0088213 | A1 | 3/2019 | Kumar et al. | |
| 2019/0338895 | A1 * | 11/2019 | Jeswani | F21K 9/238 |
| 2020/0253015 | A1 * | 8/2020 | Huang | H05B 45/395 |
| 2022/0279634 | A1 * | 9/2022 | Upton | H05B 47/16 |
| 2022/0316660 | A1 * | 10/2022 | Ray | F21K 9/272 |

* cited by examiner

300

| | Position 3 | Position 4 |
|---|---|---|
| CCT Value 1 | On | On |
| CCT Value 2 | On | Off |
| CCT Value 3 | Off | On |
| CCT Value 4 | Off | Off |

FIG. 3

200

| | Position 1 | Position 2 |
|---|---|---|
| Lumen Value 1 | On | On |
| Lumen Value 2 | On | Off |
| Lumen Value 3 | Off | On |
| Lumen Value 4 | Off | Off |

FIG. 2

LED DRIVER WITH SELECTABLE LUMEN AND CCT

FIELD OF THE DISCLOSURE

This disclosure relates to light emitting diode (LED) drivers, and specifically relates to systems and methods for integrated control of lumen and correlated color temperature (CCT) settings in LED drivers.

BACKGROUND

LEDs have gained wide-spread use and are now the dominant source of light for both consumer and commercial lighting applications, mainly due to its high energy efficiency, better light quality, and versatile form factor. One key component of LED luminaires is the LED driver, which acts like a power supply for the LED load. For example, the driver may transform power from a power source to a level suitable for powering the LED load, and also control the voltage and/or current flowing to the LED load (e.g., for dimming purposes).

LED drivers may also be used to adjust certain lighting parameters of the LED fixture, for example lumen and CCT. Lumen is a measure of the total amount of visible light emitted from a light source, while CCT is a measure of the color appearance of a light source as defined by its chromaticity coordinates to a blackbody locus. Traditionally, LED drivers had to be programmed using complicated programming tools in order to achieve the desired lumen and CCT settings. While some luminaires have features or inputs that allow a user to change the lumen or CCT, those features are external to the LED driver. Thus what is needed in the art are easier and more efficient ways to set and change the lumen and CCT parameters directly for an LED driver.

SUMMARY

Various implementations disclosed herein include a LED driver. The LED driver includes a current output module configured to generate a constant current output split between a plurality of output channels, each output channel connected to one or more LEDs having an associated correlated color temperature (CCT) value, at least one switch encoding a plurality of lumen settings and a plurality of CCT settings, and at least one circuit coupled to the current output module and the switch, the at least one circuit configured to determine a first lumen setting from the plurality of lumen settings encoded by the at least one switch, adjust the constant current output of the current output module based on the first lumen setting, determine a first CCT setting from the plurality of CCT settings encoded by the at least one switch, and adjust the plurality of output channels of the current output module based on the first CCT setting.

In some implementations, the current output module comprises a constant current flyback stage and a current splitter. In some implementations, a first CCT value associated with a first set of one or more LEDs connected to a first output channel is different from a second CCT value associated with a second set of one or more LEDs connected to a second output channel. In some implementations, the at least one switch includes a first switch having four positions, each position having an on state and an off state. In some implementations, a state of a first position and a second position encode the plurality of lumen settings. In some implementations, a state of a third position and a fourth position encode the plurality of CCT settings.

In some implementations, the first CCT setting comprises a first current for a first output channel in the plurality of output channels and a second current for a second output channel in the plurality of output channels. In some implementations, the first current is between 0.1% and 99.9% of the constant current output and the second current is the constant current output minus the first current. In some implementations, the at least one switch is directly connected to the at least one circuit. In some implementations, the at least one circuit comprises at least one microcontroller. In some implementations, the LED driver further includes a programming interface. In some implementations, the LED driver further includes a dimming circuit. In some implementations, the at least one switch includes a first switch encoding the plurality of lumen settings and a second switch encoding the plurality of CCT settings. In some implementations, the at least one circuit includes a first circuit configured to determine the first lumen setting from the plurality of lumen settings encoded by the at least one switch and adjust the constant current output of the current output module based on the first lumen setting, and a second circuit configured to determine the first CCT setting from the plurality of CCT settings encoded by the at least one switch and adjust the plurality of output channels of the current output module based on the first CCT setting.

Further implementations include a lighting fixture, including a LED driver and a plurality of LED strings coupled to the LED driver. The LED driver includes a current output module configured to generate a constant current output split between a plurality of output channels, each output channel connected to one or more LEDs having an associated correlated color temperature (CCT) value, at least one switch encoding a plurality of lumen settings and a plurality of CCT settings, and at least one circuit coupled to the current output module and the switch, the at least one circuit configured to determine a first lumen setting from the plurality of lumen settings encoded by the at least one switch, adjust the constant current output of the current output module based on the first lumen setting, determine a first CCT setting from the plurality of CCT settings encoded by the at least one switch, and adjust the plurality of output channels of the current output module based on the first CCT setting.

Further implementations include a lighting module, including a LED driver and a plurality of LED strings coupled to the LED driver. The LED driver includes a current output module configured to generate a constant current output split between a plurality of output channels, each output channel connected to one or more LEDs having an associated correlated color temperature (CCT) value, at least one switch encoding a plurality of lumen settings and a plurality of CCT settings, and at least one circuit coupled to the current output module and the switch, the at least one circuit configured to determine a first lumen setting from the plurality of lumen settings encoded by the at least one switch, adjust the constant current output of the current output module based on the first lumen setting, determine a first CCT setting from the plurality of CCT settings encoded by the at least one switch, and adjust the plurality of output channels of the current output module based on the first CCT setting.

Further implementations include a lighting system, including a LED driver and a lighting fixture coupled to the LED driver and remotely located from the LED driver, the lighting fixture comprising a plurality of LED strings. The LED driver includes a current output module configured to generate a constant current output split between a plurality of output channels, each output channel connected to one or more LEDs having an associated correlated color temperature (CCT) value, at least one switch encoding a plurality of lumen settings and a plurality of CCT settings, and at least one circuit coupled to the current output module and the switch, the at least one circuit configured to determine a first lumen setting from the plurality of lumen settings encoded by the at least one switch, adjust the constant current output of the current output module based on the first lumen setting, determine a first CCT setting from the plurality of CCT settings encoded by the at least one switch, and adjust the plurality of output channels of the current output module based on the first CCT setting.

BRIEF DESCRIPTION OF THE DRAWINGS

FIG. 2 is a table illustrating possible lumen settings for a switch on a LED driver in accordance with various implementations.

FIG. 3 is a table illustrating possible CCT settings for a switch on a LED driver in accordance with various implementations.

These and other features of the present implementations will be understood better by reading the following detailed description, taken together with the figures herein described. The accompanying drawings are not intended to be drawn to scale. For purposes of clarity, not every component may be labeled in every drawing.

DETAILED DESCRIPTION

The systems and methods described herein include a LED driver with integrated lumen and CCT control. The LED driver includes a current output module configured to generate a constant current output split between a plurality of output channels, each output channel connected to one or more LEDs having an associated CCT value, at least one switch encoding a plurality of lumen settings and a plurality of CCT settings, and at least one circuit coupled to the current output module 130 and the at least one switch. The at least one circuit is configured to adjust the constant current output of the current output module based on the lumen setting encoded in the at least one switch and adjust the plurality of output channels of the current output module based on the CCT setting encoded in the at least one switch.

The design allows a LED driver to support several different lumen and CCT configurations without any external circuitry, which helps original equipment manufacturers (OEMs) reduce the number of different fixture models to be stocked. Installers may simply use the switches on the LED driver to configure both the lumen and CCT settings for a lighting fixture instead of using complicated programming tools, reducing the possibility of mistakes.

Figure 1:
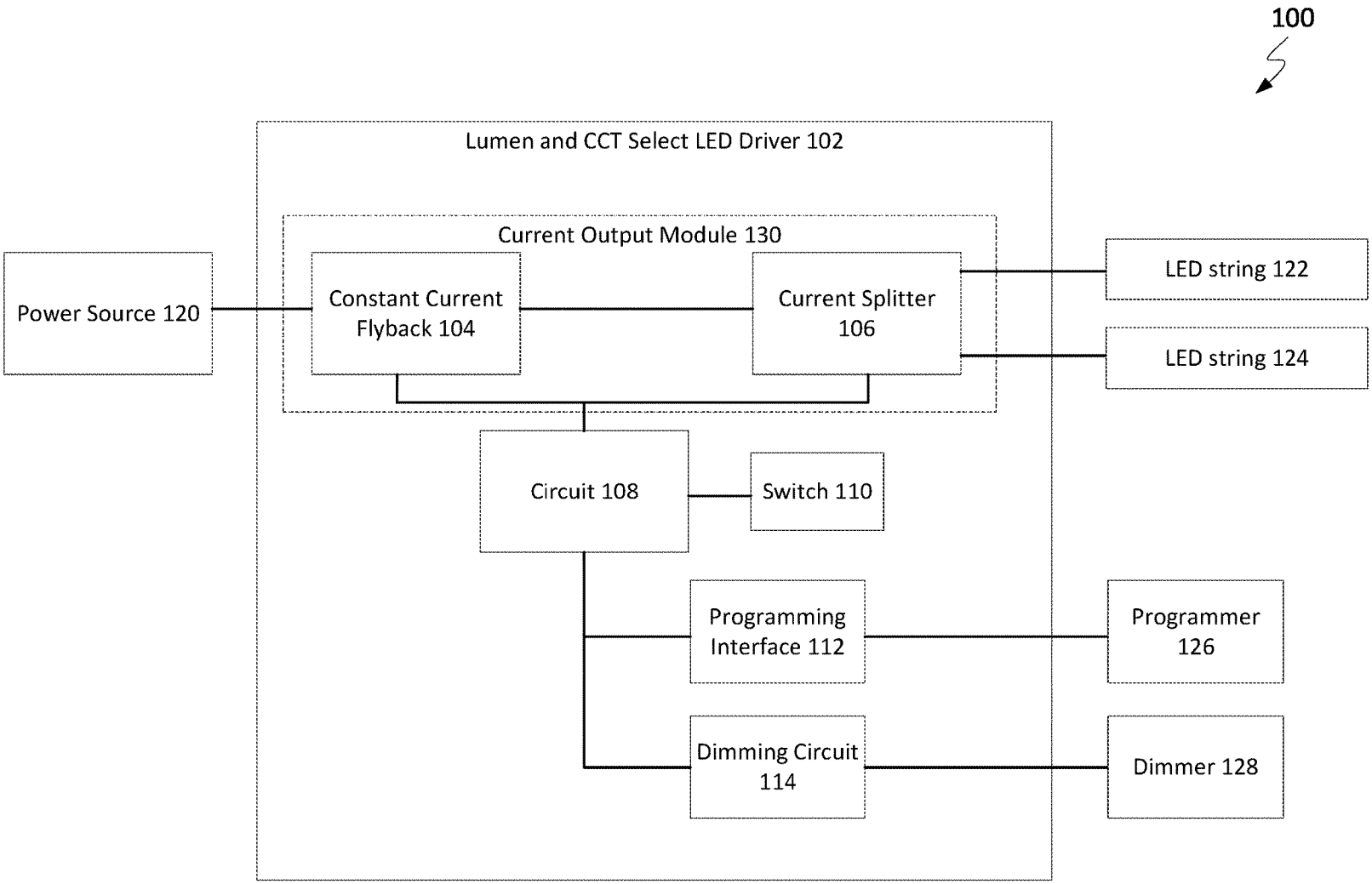
FIG. 1 is a block diagram a LED driver with selectable lumen and CCT in accordance with various implementations.

FIG. 1 is a block diagram a system 100 including a LED driver 102 with selectable lumen and CCT in accordance with various implementations. The system 100 includes a power source 120 connected to the LED driver 102. The power source 120 may be, for example, an AC power source providing between 120V-277V of power or higher (e.g., $120V_{ac}$, $220V_{ac}$, $277V_{ac}$, $347V_{ac}$, or $480V_{ac}$), a DC power source of any voltage (e.g., DC batteries), or a combination of AC and DC power sources. The LED driver 102 may include a current output module 130. The current output module 130 is configured to convert the AC input voltage from the power source 120 into a constant current output that is split among a plurality of output channels.

In some implementations, the current output module 130 may include a constant current flyback stage 104 that converts the AC input voltage from the power source 120 into a constant current output. The current output module 130 may also include a current splitter 106 that splits the output of the constant current flyback stage 104 into two or more output channels (for example, two output channels as illustrated in FIG. 1). The two output channels shown in FIG. 1 are connected to two LED strings 122 and 124. Each LED string 122, 124 may have different CCTs (e.g., $CCT_{122}$ and $CCT_{124}$). Depending on the percentage split of the constant current between the LED strings 122, 124, the combined CCT of the LED strings 122, 124 has a value between $CCT_{122}$ and $CCT_{124}$.

In some implementations, the constant current flyback stage 104 and the current splitter 106 in the current output module 130 may be replaced by another topology that also generates multiple channel outputs to the LED strings 122, 124. Alternate topologies may include, but are not limited to, a constant voltage output flyback converter with multiple constant current output buck converters, a constant voltage output flyback converter with multiple constant current output linear regulators, a constant voltage output flyback converter with a constant current output buck converter and a current splitter, a constant voltage output boost converter with a constant current output flyback converter and a current splitter, a constant voltage output boost converter with a constant current output resonant converter and a current splitter, a constant voltage output boost converter with a constant voltage resonant converter and multiple constant current output buck converters, a constant voltage output boost converter with a constant voltage output resonant converter and multiple constant current output linear regulators, and a constant voltage output boost converter with a constant voltage output resonant converter, a constant output current buck converter and a current splitter.

A circuit 108 may be connected to the current output module 130 and may be configured to adjust the output of the current output module 130 based on various inputs. In some implementations, there may be more than one circuit 108 (e.g., a first circuit connected to the constant current flyback stage 104 and a second circuit connected to the current splitter 106). In some implementations, the circuit 108 may be a microcontroller.

In some implementations, the circuit 108 may be connected to a programming interface 112, which is connected to a programmer 126 external to the LED driver 102. The programmer 126 may be used to program settings of the LED driver 102, such as the different possible lumen and CCT settings. The programming instructions from the programmer 126 may be passed to the circuit 108 via the programming interface 112, and the circuit 108 may assign the possible lumen and CCT settings to different states of at least one switch 110, as described in more detail below. In some implementations, the circuit 108 may also be connected to a dimming circuit 114, which is connected to a dimmer 128 external to the LED driver 102. A user may adjust the dimmer 128, and the user input is passed to the dimming circuit 114. The dimming circuit 114 may convert the user input into a dimming voltage, and the circuit 108 may adjust the total output current of the current output module 130 based on the determined dimming voltage. The dimming circuit 114 and dimmer 128 may encompass a number of different dimming interfaces, such as 0-10 volt dimming, phase cut dimming, DALI dimming, and wireless dimming.

The circuit 108 may also be connected to at least one switch 110 that is used the select the lumen and CCT settings for the LED driver 102. The switch(es) 110 may be directly connected to the circuit 108 without any intervening circuitry (e.g., no resistors). The switch(es) 110 may be, for example, a four position single in-line (SIP) or dual in-line (DIP) switch. The different positions of the switch(es) 110 may be used to encode both the lumen and the CCT settings for the LED strings 122, 124. For example, if there is one switch 110, two of the positions in the switch 110 may encode up to four different lumen settings for the LED driver 102, as described in further detail with reference to FIG. 2. The other two positions in the switch 110 may encode up to four different CCT settings for the LED driver 102, as described in further detail with reference to FIG. 3. The programmer 126 may be used to program the different lumen and CCT settings into the circuit 108. In some implementations, other types of switches may be used. For example, the switch(es) 110 may be a SIP or DIP switch with more or less than four positions, or may be another type of switch with any number of positions used to select lumen and CCT settings (e.g., pushbutton switches, rocker switches, rotary switches, selector switches, slide switches, tactile switches, thumbwheel switches, toggle switches).

The LED driver 102 may contain other components not shown in FIG. 1. For example, the LED driver 102 may include auxiliary voltage output circuits to driver external sensors or controllers. The LED driver 102 may contain communication modules configured for wired or wireless communication with external devices.

FIG. 2 is a table 200 illustrating possible lumen settings encoded by the at least one switch 110 in the LED driver 102 in accordance with various implementations. The switch(es) 110 may include four positions, two of which (Position 1 and Position 2 in table 200) are reserved for lumen settings. Each position may either be in an on state or an off state, resulting in four different possible combinations (on/on, on/off, off/on, and off/off). Each combination may correspond to a different or same lumen value (lumen values 1-4 in table 200), meaning the two positions may represent between 1-4 unique lumen values. For example, lumen values 1 and 2 may be different while lumen values 3 and 4 may be the same. The circuit 108 may sense the on/off state of positions 1 and 2 of the switch(es) 110, and then set the lumen output accordingly by controlling the total output current in the current output module 130.

FIG. 3 is a table 300 illustrating possible CCT settings for the switch(es) 110 in the LED driver 102 in accordance with various implementations. The switch(es) 110 may include four positions, two of which (Position 3 and Position 4 in table 300) are reserved for CCT settings. Each position may either be in an on state or an off state, resulting in four different possible combinations (on/on, on/off, off/on, and off/off). Each combination may correspond to a different or same CCT value (CCT values 1-4 in table 200), meaning the two positions may represent between 1-4 unique CCT values. For example, CCT values 1 and 2 may be different while CCT values 3 and 4 may be the same. The circuit 108 may sense the on/off state of positions 3 and 4 of the switch 110, and then set the CCT output by controlling one output channel to generate between 0.1% to 99.9% of the total current and the other output channel to generate 100% minus the percentage of the first output channel in the current output module 130. Other ranges for the output channel are also contemplated in this disclosure. For example one output channel may generate between 1% and 99% of the total current, or between 2% and 98%, or between 0.5% and 99.5%. In some implementations, neither output channel is completely off (e.g., 0% current) regardless of the selected CCT value such that both output channels have a discernable or observable effect on the combined CCT of the LED strings 122, 124.

Figure 4:
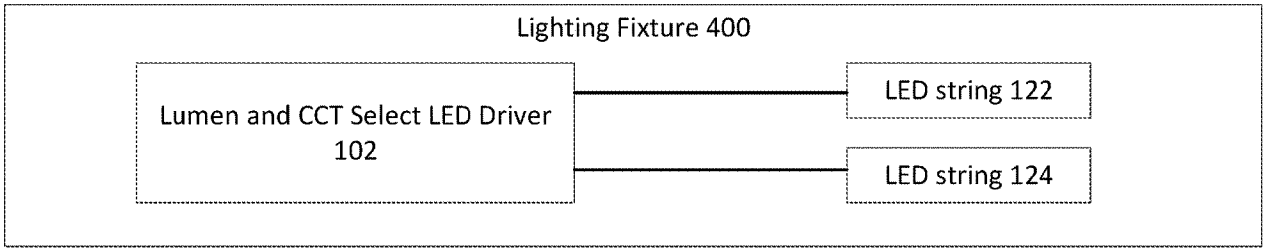
FIG. 4 is a block diagram illustrating a LED driver with selectable lumen and CCT within a lighting fixture in accordance with various implementations.

The LED driver 102 with selectable lumen and CCT settings may be incorporated into a lighting fixture or system in a number of different ways. For example, FIG. 4 is a block diagram illustrating at least one LED driver 102 within a lighting fixture 400 in accordance with various implementations. The at least one LED driver 102 may include two or more output channels, each connected to a LED string within the lighting fixture 400 (e.g., LED strings 122, 124), each string having a different CCT. Thus a user may configure the different lumen and CCT settings of the lighting fixture 400 via the LED driver 102 without the need for any other components. In other words, the LED driver 102 has integrated lumen and CCT selection capabilities.

Figure 5:
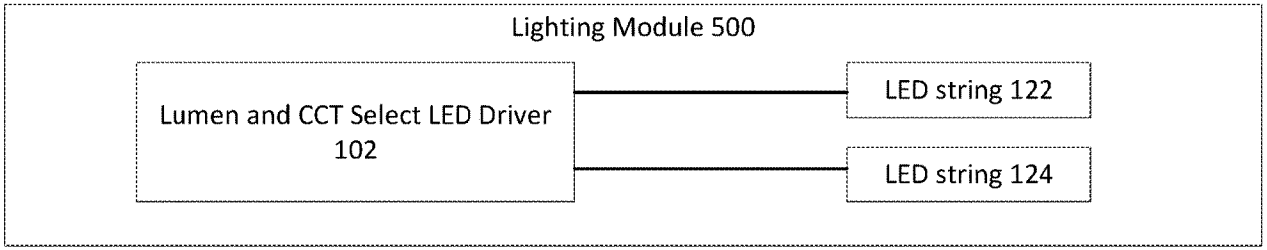
FIG. 5 is a block diagram illustrating a LED driver with selectable lumen and CCT within a lighting module in accordance with various implementations.

FIG. 5 is a block diagram illustrating at least one LED driver 102 within a lighting module 500 in accordance with various implementations. The at least one LED driver 102 may include two or more output channels, each connected to a LED string within the lighting module 500 (e.g., LED strings 122, 124), each string having a different CCT. Thus a user may configure the different lumen and CCT settings of the lighting module 500 via the LED driver 102 without the need for any other components. An LED module having a driver with integrated lumen and CCT control may be cheaper than having an external driver.

Figure 6:
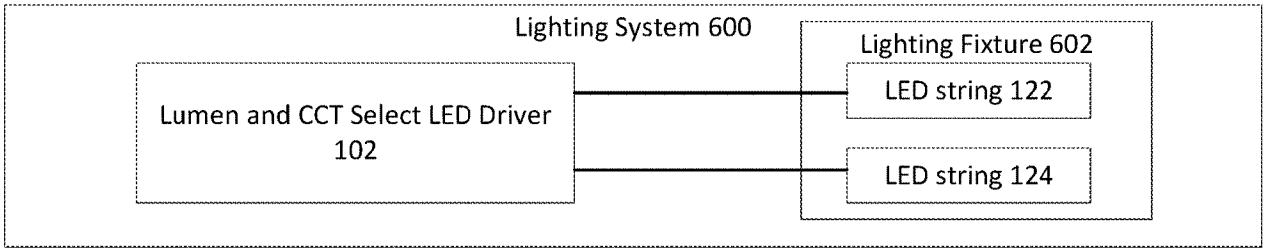
FIG. 6 is a block diagram illustrating a LED driver with selectable lumen and CCT within a lighting system in accordance with various implementations.

FIG. 6 is a block diagram illustrating the LED driver 102 within a lighting system 600 in accordance with various implementations. The lighting system 600 may include at least one LED driver 102, each LED driver 102 remotely mounted from a lighting fixture 602 that contains the LED strings 122, 124. The at least one LED driver 102 may include two or more output channels, each connected to a LED string within its respective lighting fixture 602, each string having a different CCT. Thus a user may configure the different lumen and CCT settings of the lighting fixture 602 via the LED driver 102 without the need for any other components. Remote mounting the LED driver 102 allows for easier maintenance of the driver.

Other Considerations

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, Blu-Ray, magnetic disk, internal hard drive, external hard drive, memory stick, flash drive, solid state memory device, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some implementations, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s), handheld device(s) such as cellular telephone(s) or smartphone(s) or tablet(s), laptop(s), laptop/tablet hybrid(s), handheld computer(s), smart watch(es), or any another device(s) capable of being integrated with a processor(s) that may operate as provided herein. Accordingly, the devices provided herein are not exhaustive and are provided for illustration and not limitation.

References to "a microcontroller" and "a processor", or "the microcontroller" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

The foregoing description of the implementations of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. A light emitting diode (LED) driver, comprising:

a current output module configured to:

generate a constant current output split between a plurality of output channels, each output channel connected directly to one or more LEDs having an associated correlated color temperature (CCT) value;

at least one switch disposed on the LED driver, the at least one switch configured to encode a plurality of lumen settings and a plurality of CCT settings; and at least one circuit coupled to the current output module and the switch, the at least one circuit configured to:

determine a first lumen setting from the plurality of lumen settings encoded by the at least one switch;

adjust the constant current output of the current output module based on the first lumen setting;

determine a first CCT setting from the plurality of CCT settings encoded by the at least one switch; and adjust the plurality of output channels of the current output module based on the first CCT setting, wherein an input of the LED driver is connected directly to an external power source.

2. The LED driver of claim 1, wherein the current output module comprises a constant current flyback stage and a current splitter.

3. The LED driver of claim 1, wherein a first CCT value associated with a first set of one or more LEDs connected to a first output channel is different from a second CCT value associated with a second set of one or more LEDs connected to a second output channel.

4. The LED driver of claim 1, wherein the at least one switch comprises a first switch having four positions, each position having an on state and an off state.

5. The LED driver of claim 4, wherein a state of a first position and a second position encode the plurality of lumen settings.

6. The LED driver of claim 4, wherein a state of a third position and a fourth position encode the plurality of CCT settings.

7. The LED driver of claim 1, wherein the first CCT setting comprises a first current for a first output channel in the plurality of output channels and a second current for a second output channel in the plurality of output channels.

8. The LED driver of claim 7, wherein:

the first current is between 0.1% and 99.9% of the constant current output; and the second current is the constant current output minus the first current.

9. The LED driver of claim 1, wherein the at least one switch is directly connected to the at least one circuit.

10. The LED driver of claim 1, wherein the at least one circuit comprises at least one microcontroller.

11. The LED driver of claim 1, further comprising a programming interface.

12. The LED driver of claim 1, further comprising a dimming circuit.

13. The LED driver of claim 1, wherein the at least one switch comprises a first switch encoding the plurality of lumen settings and a second switch encoding the plurality of CCT settings.

14. The LED driver of claim 1, wherein the at least one circuit comprises:

a first circuit configured to determine the first lumen setting from the plurality of lumen settings encoded by the at least one switch and adjust the constant current output of the current output module based on the first lumen setting; and a second circuit configured to determine the first CCT setting from the plurality of CCT settings encoded by the at least one switch and adjust the plurality of output channels of the current output module based on the first CCT setting.

15. A lighting fixture, comprising:

a LED driver as described in claim 1; and a plurality of LED strings coupled to the LED driver.

16. A lighting system, comprising:

a LED driver as described in claim 1; and a lighting fixture coupled to the LED driver and remotely located from the LED driver, the lighting fixture comprising a plurality of LED strings.

* * * * *